US006192684B1

(12) United States Patent
McBirney

(10) Patent No.: US 6,192,684 B1
(45) Date of Patent: Feb. 27, 2001

(54) MECHANICAL ACTUATOR ASSEMBLY

(75) Inventor: Thomas R. McBirney, Columbia, MD (US)

(73) Assignee: Swales Aerospace, Beltsville, MD (US)

( * ) Notice: Subject to any disclaimer, the term of this patent is extended or adjusted under 35 U.S.C. 154(b) by 0 days.

(21) Appl. No.: 09/271,549

(22) Filed: Mar. 18, 1999

(51) Int. Cl.[7] ..... F01B 29/10
(52) U.S. Cl. ..... 60/528; 60/527
(58) Field of Search ..... 60/527, 528, 530; 92/146, 161

(56) References Cited

U.S. PATENT DOCUMENTS

| | | | | |
|---|---|---|---|---|
| 3,212,337 | * | 10/1965 | McCarrick | 60/530 |
| 3,220,191 | * | 11/1965 | Berchtold | 60/530 X |
| 3,785,252 | * | 1/1974 | Cornair | 92/161 |
| 4,095,427 | * | 6/1978 | Stropkay | 60/530 |
| 5,020,325 | | 6/1991 | Henault | 60/528 |
| 5,025,627 | | 6/1991 | Schneider | 60/527 |
| 5,222,362 | | 6/1993 | Maus et al. | 60/527 |
| 5,396,770 | | 3/1995 | Petot et al. | 60/531 |
| 5,419,133 | | 5/1995 | Schneider | 60/527 |
| 5,666,810 | * | 9/1997 | Miesterfeld et al. | 60/530 |
| 5,685,149 | | 11/1997 | Schneider et al. | 60/528 |
| 5,720,169 | | 2/1998 | Schneider | 60/530 |
| 5,738,658 | | 4/1998 | Maus et al. | 604/151 |

* cited by examiner

*Primary Examiner*—Hoang Nguyen
(74) *Attorney, Agent, or Firm*—Roberts Abokhair & Mardula, LLC

(57) ABSTRACT

A mechanical actuator assembly is disclosed. The actuator assembly comprises an actuator body with an element moveable with respect to said body to perform a function. In general, the moveable element is in the form of a piston or a rod. The actuator assembly further comprises a mounting mechanism allowing the movement of the actuator body relative to the moving element or piston in response to preset conditions of pressure or force.

6 Claims, 1 Drawing Sheet

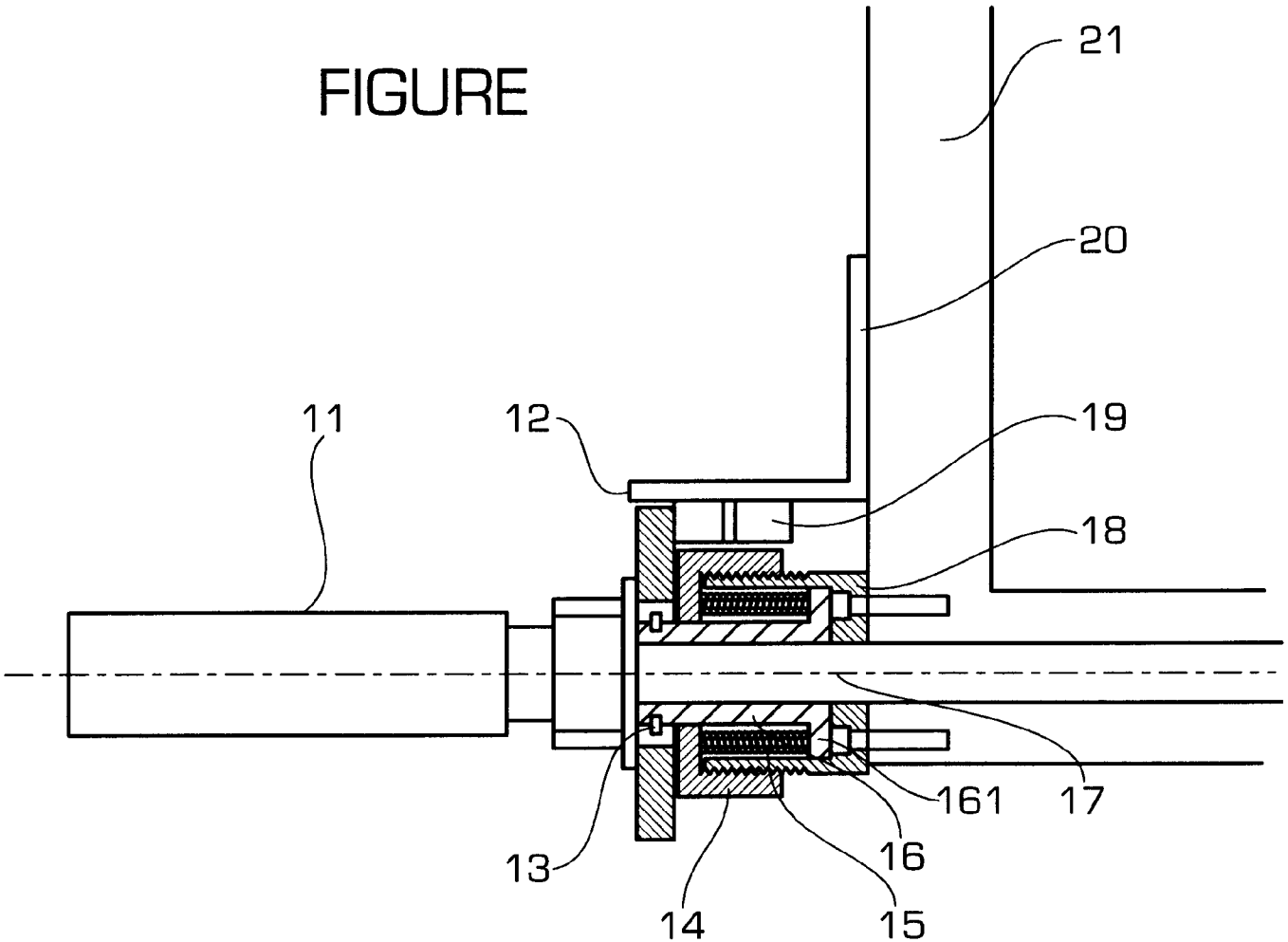
FIGURE

MECHANICAL ACTUATOR ASSEMBLY

BACKGROUND

The present invention relates to mechanical actuators. More particularly, the present invention is applied in conjunction with high force, low travel linear actuators.

Actuators, such as high output force actuators are well known in the art. Some high output force actuators are motor or gear box driven, such as a ball screw actuator with a high ratio motor/gear box drive. Others are pneumatic, hydraulic or thermochemically driven. Thermochemical actuators usually employ a thermally expansible medium or compound, such as a wax, to extend a piston and thereby drive an external device.

Examples of the actuators are disclosed in U.S. Pat. No. 5,025,627 (Schneider). U.S. Pat. No. 5,396,770 (Petot et al.), U.S. Pat. No. 5,020,325 (Henault), U.S. Pat. No. 5,685,149 (Schneider et al.), U.S. Pat. No. 5,738,658 (Maus et al.), U.S. Pat. No. 5,720,169 (Schneider), U.S. Pat. No. 5,419,133 (Schneider), and U.S. Pat. No. 5,222,362 (Maus et al.), the disclosures of which are whereby incorporated by reference in their entirety.

These thermochemical actuators are described with various nomenclature including heat motors, thermochemical actuators, mechanical actuators, electrothermal actuators, high output paraffin actuators (HOP actuators), pneumatic actuators, hydraulic actuators, and the like. All of these devices actuate a shaft in response to heat energy. The heat is applied to a variable volume chamber filled with a working medium such as wax or fluid. The working medium expands, thus expanding the chamber volume and driving the shaft or piston. The motion of the shaft can be used to drive various external devices. These actuators are utilized in various applications including automotive systems and satellites. Wax actuators are used in automobile radiators to open a water circulation valve when the engine reaches operating temperature.

For example, high output paraffin (HOP) actuators are made by Starsys, Inc. in Boulder, Colo. They use paraffin, or wax, as an actuating technique by utilizing the about 15% volume expansion that occurs when paraffin melts. The volume expansion increases the hydrostatic pressure in a pressure housing, applying that pressure to a rubber boot that squeezes an output rod out of the HOP housing.

When using such actuators, it is absolutely essential to have an external means of removing power to stop heating of the paraffin when the actuator stroke is complete or whenever the output rod has reached an immovable external stop. Otherwise, the pressure in the actuator housing will continue to increase, destroying the actuator. However, if the means to remove power does not function properly or fast enough, the actuator may be destroyed. There is a need for a means of absorbing the increase in pressure in the actuator even if the power supply is not removed.

The most commonly used means for heating the paraffin or wax is an electrical heater. Some techniques for removal of power include using a position sensor, such as a microswitch or reed switch, to sense the end of stroke and, either directly or indirectly, interrupt power to the actuator heaters. As soon as power is removed, the actuator output rod starts to retract, the position sensor again applies power to the actuator, and this cycle continues until power is removed from the circuit. A drawback to this technique is that, if the actuator output rod encounters an obstruction, either intentional or unintentional, before it reaches its planned end of stroke, the switch at the end of stroke is not triggered, and the actuator will be destroyed.

Many users of paraffin actuators have, at one time or another, damaged an actuator through inadvertent mishandling while testing various systems. Specifically, if one leaves the power applied to the internal heaters after (a) the output rod has reached the end of its travel or (b) the output rod has met an immovable obstruction such as the end of travel of the adjacent components, the internal pressure in the paraffin chamber increases to a point where internal parts of the actuator fail in accordance with design, preventing external release of the wax. This failure requires the return of the actuator to the manufacturer for repairs at significant cost.

When such actuators are utilized in aircraft or spacecraft, it becomes more important to provide a means for eliminating actuator failure resulting from pressure buildup. Additionally, when such actuators are used in remote applications, such as orbiting satellites, failure of the actuator may result in the loss of the satellite, discharge of the expanding medium on other parts of the satellite, destruction of the piston or actuation rod, or other damage to the satellite system. This damage can occur when the power removal mechanism fails or when external heat is applied other than from the intended power source. Additionally, when used in such remote applications, it is desirable to be able to reuse the actuator after such failure or pressure build-up.

Accordingly, there is a need for a system that would eliminate failure of the actuator due to pressure buildup even if the power supply to the actuator is maintained.

Additionally, there is a need for a system that eliminates failure of the actuator due to pressure buildup, by allowing the piston or actuator rod to travel its full path even in the face of an obstruction.

There is also a need for a thermochemical actuator that is reusable even after excessive pressure triggers a release mechanism.

There is also a need for an actuator safety mechanism for an actuator that can be triggered without any external input or power.

SUMMARY

The present invention is directed to a mechanical actuator apparatus that satisfies the above mentioned needs. An actuator having features of the present invention comprises a body, a thermally responsive expansion material contained in the body, and an element, such as a piston or a rod, that is movable with respect to the body of the actuator and performs a function. The body of the actuator is attached to whatever larger apparatus that it forms a part of through a mounting mechanism that allows the movement of the body relevant to the moving element in response to preset conditions in the body of the actuator. These preset conditions could be related to a threshold pressure, temperature, or moving force of the actuator arm or piston. In a preferred embodiment, the mounting mechanism is a linear slide, spring-loaded against a stop and attached to the body of the actuator wherein the slide retracts when output force exceeds the spring preload.

In yet another preferred embodiment, a microswitch or a break to the power supply is included in the mounting mechanism such that the power to the actuator heater is removed when the slide retracts.

An advantage of the present invention is that it eliminates failure of the actuator due to pressure buildup even if the power supply to the actuator is maintained after the maximum actuator force is achieved.

Another advantage of the present invention is in providing a system that eliminates failure of an actuator due to pressure buildup, by allowing the piston or actuator rod to travel its full path even in the face of an obstruction.

Another advantage of the present invention is in providing a thermochemical actuator that is reusable after excessive pressure triggers a release mechanism.

Yet another advantage of the present invention is providing a safety mechanism for an actuator that can be triggered without any external input or power.

These and other features, aspects, and advantages of the present invention will become better understood with reference to the following drawings, description, and appended claims.

DRAWINGS

The FIGURE shows an embodiment of the invention wherein a spring-loaded slide mechanism is utilized as part of a thermal actuator system.

DESCRIPTION

The present invention is applicable to any system utilizing any high output force actuator that could be damaged by overloading. While one version of the present invention will be described in conjunction with thermochemical actuators, and particularly high output paraffin actuators, it is applicable to other high output force actuators, such as a ball screw actuator with a high ratio motor/gear box drive. Other mechanical, pneumatic, hydraulic and thermal actuators are utilized.

In accordance with the embodiment shown in the FIGURE, a high output paraffin (HOP) actuator 11 is shown. It should be understood that the actuators contemplated in the present invention are part of a larger structure, such as a satellite system, wherein the actuator is triggered to perform one function within the larger structure. Operations of HOP actuators are well known in the art and are available commercially from various vendors.

For example, a HOP actuator useful in the present invention comprises a chamber which has a passage through which a piston or extensible member is slidably received. An expandable medium, such as a wax, fills the chamber. The wax expands significantly as it changes phase from solid to liquid. Wax, for example, commonly increases from 12 to 15% in volume as it changes from its solid to liquid state.

A temperature changing means, such as a Peltier effect thermoelectric heating/cooling chip, selectively adds and removes heat from the expandable medium in the chamber. When connected with a source of electricity of one polarity, the Peltier effect chip heats its surface closest to the chamber to transmit heat energy into the wax. When connected with the opposite polarity, the Peltier chip draws heat from its face against the chamber and discharges the heat through cooling fins. For speed of operation, it is advantageous to hold the expandable medium substantially at its melting temperature.

When thermal energy is applied to room temperature wax, the wax retains its solid form but increases in temperature until it reaches its melting point. The additional energy necessary to change the wax from the solid to liquid phase is supplied by the application of additional thermal energy. However, the absorbed thermal energy causes an isothermal phase change rather than increasing the temperature of the wax until the phase change is completed. If additional thermal energy is applied after the phase change, the liquid wax would increase in temperature. When thermal energy is removed, the liquid wax isothermally solidifies. In this manner the wax expands and contracts about 12 to 15% as heat is added to or removed from the wax which is held at its melting point temperature.

Various means for controlling the expandable medium temperature may be employed and are well known in the art. Depending on the application, various means may be employed to control the speed with which the expandable medium expands or contracts. The speed of expansion and contraction would control the speed of the operation of the piston or the actuation rod.

The high output force actuators usually comprise an output rod that would move from about halfan inch to about 1.5 inches, with a traveling force of up to 150 pounds. Another type of high force linear actuator would be a threaded rod, using steel balls in the thread groove, to transmit motion and force from a mating threaded nut. The nut is rotated by a high ratio gearbox driven by a motor. The threaded rod is restrained from rotating with the nut, so it translates linearly, exerting linear force and consequent linear motion on an external load. Other mechanical, pneumatic, hydraulic and thermal actuators are utilized. An aspect of the present invention is the mounting mechanism that allows the movement of the actuator body relative to the moving element or piston. Previously known mounting mechanisms fix the body of the actuator to the applicable structure, such as a satellite. The only moving element relative to the structure is the piston or force output rod. The mounting mechanism of the present invention provides for movement of the actuator body relative to the structure.

The HOP actuator 11 is attached to plate 12, which serves to retain the HOP in its position and transmit the reaction force to slide 16. Further, in accordance with the embodiment shown in the FIGURE, the plate transmits the spring compression motion to microswitch 19.

The HOP is attached to the slide 16 through various means, including a snap ring 13 or other methods. Other methods include attaching the HOP to the slide with screw threads, welded assembly, adhesive bonding, drill and pin and the like. The cap 14 is employed to retain and preload spring 15 against the slide flange 161. The cap also guides the linear motion of one end of the slide. The cap may be attached to the body of the mount with various means, including these mentioned above for the attachment of the HOP to the plate.

The spring 15 provides a reference preload force that the actuator acts against. Various springs or other compliant members may be utilized in the present invention. For example, coil springs or Belleville washer springs may be utilized. In a preferred embodiment of the present invention, the tension of the spring may be adjusted, dependent on the application.

The slide 16 transmits the HOP reaction force to the spring. Additionally, the slide transmits the spring compression motion to the plate.

The guide housing 18 guides the linear motion of one end of the slide 16 and transmits spring force from cap to other end of spring. The bracket 20 supports the microswitch 19 in accordance with a preferred embodiment of the present invention. The microswitch senses the motion of the plate 12 and controls power to the HOP 11 heaters. A linear position sensor with an output proportional to position and therefore (due to the linear spring) force, can also be used for accurate proportional force control. This force is optionally remotely commanded. Other sensors which can be utilized include optical motion sensors or magnetic motion sensors, or the like. In a preferred embodiment, movement of the plate in response to the movement of the slide would break the power supply to any heaters employed in the HOP actuator.

The invention has been described with respect to certain preferred embodiments. Various changes and modifications to the embodiments herein, chosen for purposes of illustration, will readily occur to those skilled in the art. To the extent that such modifications and variations do not depart from the spirit of the invention as claimed herein, they are intended to be included within the scope thereof.

What is claimed is:

1. An actuator comprising:

a body;

an element movable with respect to said body to perform a function; and a mounting mechanism allowing the movement of the body relative to the moving element in response to preset conditions;

wherein the actuator is selected from the group consisting of: high output force mechanical, pneumatic, hydraulic, and thermochemical actuators; and wherein the mounting mechanism comprises a linear slide spring loaded into a stop and attached to the body of the actuator wherein the slide retracts when output force exceeds spring preload.

2. A thermal actuator comprising:

a body comprising a chamber filled with a medium that expands and contracts in response to thermal conditions;

a piston slidably received in the chamber for extending as the medium expands generating an output force; and a mounting mechanism for attaching the actuator to a larger device comprising a linear slide spring-loaded into a stop and attached to the body of actuator wherein the slide retracts when output force exceeds spring preload.

3. The actuator of claim 2 further comprising a switch wherein the switch shuts off power supply to the actuator when the linear slide travels a preset distance.

4. The actuator of claim 2 wherein the spring preload is remotely changed.

5. A mounting mechanism for attaching an actuator to a mechanical structure comprising, a plate to retain the actuator in its position, a linear slide attached to the actuator, a spring with a preset load value attached to the slide, and a mounting bracket, wherein the linear slide moves the actuator away from the mechanical structure when the actuator force exceeds the preset load value of the spring.

6. The mounting mechanism of claim 5 further comprising a microswitch attached to the mounting bracket wherein the microswitch shuts off power to the actuator when the slide movement exceeds a preset distance.

* * * * *

UNITED STATES PATENT AND TRADEMARK OFFICE

CERTIFICATE OF CORRECTION

PATENT NO. : 6,192,684 B1
APPLICATION NO. : 09/271549
DATED : February 27, 2001
INVENTOR(S) : Thomas R. McBirney It is certified that error appears in the above-identified patent and that said Letters Patent is hereby corrected as shown below:

| | | | |
|---|---|---|---|
| | In the FIGURE, | | delete reference numerals “17” and “21” together with their associated lead lines |
| | COLUMN 1, | LINE 21, | change “whereby” to --hereby-- |
| | COLUMN 3, | LINE 16, | change “FIGURE” to --Figure-- |
| | COLUMN 3, | LINE 32, | change “FIGURE,” to --Figure,-- |
| | COLUMN 4, | LINE 12, | change “about halfan inch” to --about half an inch-- |
| | COLUMN 4, | LINE 33, | change “FIGURE,” to --Figure,-- |
| CLAIM 2, | COLUMN 6, | LINE 6, | change “body of actuator” to --body of the actuator-- |

Signed and Sealed this

Seventh Day of October, 2008

JON W. DUDAS
*Director of the United States Patent and Trademark Office*